US011473374B2

(12) United States Patent
Dietrich et al.

(10) Patent No.: US 11,473,374 B2
(45) Date of Patent: Oct. 18, 2022

(54) DEPLOYMENT TOOL AND DEPLOYMENT TOOL ASSEMBLY

(71) Applicant: NTDrill Holdings, LLC, Houston, TX (US)

(72) Inventors: Earl Dietrich, Fulshear, TX (US); Christian Leuchtenberg, Shamrock Park (SG); Glen Cuiper, Haddon Township, NJ (US)

(73) Assignee: NTDrill Holdings, LLC, Houston, TX (US)

( * ) Notice: Subject to any disclaimer, the term of this patent is extended or adjusted under 35 U.S.C. 154(b) by 9 days.

(21) Appl. No.: 17/136,098

(22) Filed: Dec. 29, 2020

(65) Prior Publication Data

US 2021/0198954 A1 Jul. 1, 2021

Related U.S. Application Data

(60) Provisional application No. 62/955,345, filed on Dec. 30, 2019.

(51) Int. Cl.
*E21B 17/046* (2006.01)

(52) U.S. Cl.
CPC ..... *E21B 17/0465* (2020.05)

(58) Field of Classification Search
CPC .... E21B 17/03; E21B 17/046; E21B 17/0465; E21B 33/08; E21B 33/085
See application file for complete search history.

(56) References Cited

U.S. PATENT DOCUMENTS

| | | | | |
|---|---|---|---|---|
| 4,040,481 | A | 8/1977 | Coussan | |
| 4,269,268 | A | 5/1981 | Cowan | |
| 10,077,604 | B2 | 9/2018 | Chambers | |
| 10,450,823 | B1 | 10/2019 | Pruitt et al. | |
| 10,648,262 | B2 * | 5/2020 | Tran | E21B 31/18 |

(Continued)

FOREIGN PATENT DOCUMENTS

| | | | |
|---|---|---|---|
| EP | 2896781 | A1 | 7/2015 |
| GB | 2004356 | A | 3/1979 |

(Continued)

OTHER PUBLICATIONS

GB Intellectual Property Office, Search Report for corresponding application No. GB2004356.8. Search Report for corresponding application No. GB2004356.8 dated Mar. 26, 2020. 1 page.

*Primary Examiner* — David Carroll
(74) *Attorney, Agent, or Firm* — K&L Gates LLP

(57) ABSTRACT

A deployment tool that can be used on land, jack-up and floating drilling rigs. The tools is installed around a drillpipe tool joint making it independent of the drill string load path as well as independent of the drill pipe thread and drill pipe size. It is designed for the largest commonly used drillpipe size, so has a single outer dimeter configuration that can be adapted from the largest drillpipe to the smallest in use with simple mechanical adapters. Thus, one main tool and a set of adapters is all that is required. The tool may be used in the deployment of RCDs, for example in the landing of an RCD bearing assembly on an RCD housing, or in the deployment of tubing hangers, lining hangers, casing hangers or other or any other temporary completion tool.

21 Claims, 7 Drawing Sheets

(56) References Cited

U.S. PATENT DOCUMENTS

| | | | | |
|---|---|---|---|---|
| 2003/0106712 | A1* | 6/2003 | Bourgoyne | E21B 33/085<br>166/358 |
| 2015/0144400 | A1* | 5/2015 | Leuchtenberg | E21B 33/08<br>175/25 |
| 2021/0348450 | A1* | 11/2021 | Symonds | E21B 21/08 |

FOREIGN PATENT DOCUMENTS

| | | | |
|---|---|---|---|
| WO | 2013006963 | A1 | 1/2013 |
| WO | 2021016053 | A1 | 1/2021 |

* cited by examiner

DEPLOYMENT TOOL AND DEPLOYMENT TOOL ASSEMBLY

FIELD OF INVENTION

This invention relates in general to fluid drilling equipment and in particular to deployment tool for deploying equipment to be used for drilling operations. More specifically, embodiments of the present disclosure relate to a running and pulling tool for deploying an RCD bearing assembly into an RCD housing or riser. The tool can be used on land, jack-up and floating drilling rigs.

BACKGROUND OF INVENTION

In drilling a well, a drilling tool or "drill bit" is rotated under an axial load within a bore hole. The drill bit is attached to the bottom of a string of threadably connected tubulars or "drill pipe" located in the bore hole. The drill pipe is rotated at the surface of the well by an applied torque which is transferred by the drill pipe to the drill bit. As the bore hole is drilled, the hole bored by the drill bit is substantially greater than the diameter of the drill pipe. To assist in lubricating the drill bit, drilling fluid or gas is pumped down the drill pipe. The fluid jets out of the drill bit, flowing back up to the surface through the annulus between the wall of the bore hole and the drill pipe.

Conventional oilfield drilling typically uses hydrostatic pressure generated by the density of the drilling fluid or mud in the wellbore in addition to the pressure developed by pumping of the fluid to the borehole. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with low change in pressure. Underbalanced drilling is drilling with the hydrostatic head of the drilling fluid intentionally designed to be lower than the pressure of the formations being drilled. The hydrostatic head of the fluid may naturally be less than the formation pressure, or it can be induced.

Rotating control devices provide a means of sealing off the annulus around the drill pipe as the drill pipe rotates and translates axially down the well while including a side outlet through which the return drilling fluid is diverted. Such rotating control devices may also be referred to as rotating blow out preventers, rotating diverters or drilling heads. These units generally comprise a stationary housing or bowl including a side outlet for connection to a fluid return line and an inlet flange for locating the unit on a blowout preventer or other drilling stack at the surface of the well bore. Within the bowl, opposite the inlet flange, is arranged a rotatable assembly such as anti-friction bearings which allow the drill pipe, located through the head, to rotate and slide. The assembly includes a seal onto the drill pipe which is typically made from rubber, polyurethane or another suitable elastomer.

For offshore application on jack-up drilling rigs or floating drilling rigs the rotating control device may be in the form of a bearing assembly that is latched inside the drilling fluid return riser. This requires lowering the RCD bearing assembly from the rig floor, on a tool that securely holds the bearing assembly, then the bearing assembly is latched in place by some sort of mechanism. Thereafter the pulling tool needs to be released from the bearing assembly and recovered to the rig floor. Sometimes such a tool is also required on land drilling rigs operating with a diverter system where the rig-up is very similar to that of a jack-up drilling rig.

The procedure involves installation of the RCD just before pressurized drilling operations start which means that there may be substantial amounts of pipe in the hole. This has meant that state of the art RCD bearing deployment tools (RBDT) like the one described in published application US20180340386A1 by Schlumberger, are special tools that require interfacing with the multitude of possible drillpipe sizes and threads in common use. This requires special adapters to be built for the RBDT and also because the RBDT is a load bearing element for the whole drill string weight it requires special testing and re-certification at intervals.

What is needed is a new design of RBDT that can be: a) adapted to any drillpipe size & thread quickly and cost effectively; b) be independent of the load path of the drill string below and c) have a simple mechanism not involving shear pins or other single shot feature, meaning that it can be reused several times without re-dressing the tool. This is the intent of the invention being described herein.

The advantageous design will enable the installation or de-installation of RCD bearings to be done in with a minimal set of adapters covering common drillpipe sizes. These adapters are independent of the thread of the drillpipe thus enabling the same RBDT to be used across a wide range of drillpipe.

Furthermore, the design can be used for deployment of any device that would usually be deployed with drillpipe on a drilling rig. As such it is termed a "universal" running and pulling tool as the principles lend themselves to a multitude of applications like a liner running tool or other applications where an item must be run into the well bore, thereafter recovering the running tool or for recovering an item with a pulling tool.

SUMMARY

A deployment tool that can be used on land, jack-up and floating drilling rigs. The tool may be installed around a drillpipe tool joint making it independent of the direct vertical load path of the drill string weight below the RBTD, as well as independent of the drill pipe thread and drill pipe size. It is designed for the largest commonly used drillpipe size, so has a single outer and inner dimeter configuration that can be adapted for use with a smaller drill pipe with simple mechanical adapters. Thus, one main tool and a set of adapters is all that is required. The deployment tool has a simple mechanism which does not involve shear pins or any other single shot feature, so that it can be reused without re-dressing the tool. The tool may be used in the deployment of RCDs, for example in the landing of an RCD bearing assembly on an RCD housing, or in other applications where an item must be run into the wellbore before recovering the running tool, or for recovering an item with a pulling tool. For example it could be used in the deployment of tubing hangers, lining hangers, casing hangers or any other temporary wellbore completion or drilling tool.

According to a first embodiment we provide a deployment tool comprising a latch assembly and two adapters whereby the latch assembly can be releasably secured to a drill string, the latch assembly comprising a tubular housing with an interior surface, and a resiliently deformable latch which is retained by the housing, wherein the adapters are releasably secured to the interior surface of the housing spaced from one another along the housing.

The adapters may be tubular or annular. The adapters may each be formed from a plurality of arcuate parts which when put together can partially, almost completely or completely surround a portion of a drill pipe.

The latch may be tubular, and have a body which encloses a generally cylindrical passage with a longitudinal axis. In this case, the latch may have a main slot which extends parallel to the longitudinal axis and all the way through the body, so that the latch has a generally C-shaped transverse cross-section.

The latch may be provided with a plurality of smaller slots which also extend into the body generally parallel to the longitudinal axis, but which do not fully penetrate through the body.

A radially outwardly or radially inwardly facing surface of the latch may be provided with a circumferential ridge.

The ridge may be provided with two angled shoulders over which the outer diameter of the latch increases generally linearly to a maximum at the peak of the ridge.

The shoulder angles, i.e. the angle of the radially outwardly facing surface of the latch at the shoulder to the longitudinal axis of the latch for the two shoulders of the ridge may be different.

The latch housing may comprise first and second housings, the first housing being configured to be mounted around and releasably secured to the first adapter and the second housing being configured to be mounted around and releasably secured to the second adapter, and each of the first and second housings having a latch retainer formation which is configured to receive one end of the latch so that the latch can be captured between the first and second housings.

The latch assembly housing may comprise first and second housings, the first housing being secured to the first and second adapters, and the second housing having a latch retainer formation which is configured receive and retain the latch.

According to a second embodiment we provide a deployment tool assembly comprising a first and second drillpipe connected end to end by a tool joint which has a larger outer diameter than the adjacent portions of the drillpipes, the deployment tool assembly further comprising a deployment tool according to the first embodiment, wherein the first adapter is mounted around the first drill string adjacent to the tool joint, and the second adapter is mounted around the second drill string adjacent to the tool joint, so that the tool joint lies between the first and second adapters.

The housing may deployment tool assembly may therefore be secured to the drill string by the engagement of the adapters with the tool joint, at least a portion of the housing extending around the tool joint.

The adapters may be tubular or annular.

The adapters may each be formed from a plurality of arcuate parts which when put together partially, almost completely or completely surround a portion of a drill pipe.

The latch may be tubular, and have a body which encloses a generally cylindrical passage with a longitudinal axis. In this case, the latch may have a main slot which extends parallel to the longitudinal axis and all the way through the body, so that the latch has a generally C-shaped transverse cross-section.

The latch may be provided with a plurality of smaller slots which also extend into the body generally parallel to the longitudinal axis, but which do not fully penetrate through the body.

A radially outwardly or radially inwardly facing surface of the latch may be provided with a circumferential ridge.

The ridge may be provided with two angled shoulders over which the outer diameter of the latch increases generally linearly to a maximum at the peak of the ridge.

The shoulder angles, i.e. the angle of the radially outwardly facing surface of the latch at the shoulder to the longitudinal axis of the latch for the two shoulders of the ridge may be different.

The adapters may be bolted to the housing or secured to the housing by a screw thread.

The housing may comprise a first housing and a separate second housing, the first housing being secured to the first adapter, and second housing being secured to the second adapter, and the latch being located in the latch retainer formation of each housing so that the latch lies between and is captured by the first and second housing. In this case, the first housing may be bolted to the first adapter, and the second housing bolted to the second adapter.

The housing may comprise a first housing and a separate second housing, the first housing being secured to the first and second adapters, and the second housing being having a latch retainer formation which is configured to receive and retain the latch.

The assembly may further comprise an apparatus or tool which has a tool latch and which is mounted on the deployment tool by engagement of a circumferential groove or ridge provided on the tool latch with the ridge of the latch of the deployment tool. In this case, the angle of the shoulders closer to the apparatus or tool to which the deployment tool is connected a may be greater than the angle of the shoulders further from the apparatus or tool.

The assembly may further comprise an apparatus or tool comprising a funnel latch and being mounted on the deployment tool by engagement of the funnel latch with the latch of the deployment tool. For example, the apparatus or tool may be an RCD bearing assembly which is configured to be secured to an upper end of an RCD housing.

The funnel latch may have a tubular body with lower end and an upper end, which encloses a generally cylindrical main passage.

The funnel latch may be provided with a landing shoulder which extends from a radially inwardly facing surface of the tubular body into the main passage on which a lowermost end of the second adapter is landed.

The funnel latch may be provided with a circumferential recess which extends into a radially inwardly facing surface of the tubular body, and the latch may have a corresponding circumferential ridge which extends radially outwardly from a radially outwardly facing surface of the latch, the ridge being located in the recess to connect the apparatus or tool to the deployment tool.

The recess may be provided with two angled shoulders over which the interior diameter of the funnel latch increases generally linearly to a maximum at the bottom of the recess. The angle of the radially inwardly facing surface of the funnel latch at the shoulder to the longitudinal axis of the funnel latch may be different for the two shoulders of the recess. The angle of the shoulders closest to the apparatus or tool may be greater than the angle of the shoulders further from the apparatus or tool.

According to a third embodiment we provide a deployment tool comprising a first housing slidable over a drillstring with a second housing attached and a resiliently deformable latch, the first housing being configured to have removable split adapters for securing said housing to the drillstring to the point of the interface of two pipes termed as a tool-joint.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF EMBODIMENTS OF THE INVENTIONS

Embodiments of the principles of the present inventions are best understood by referring to FIGS. 1 to 4 of the drawings, in which like numbers designate like parts.

Figure 1:
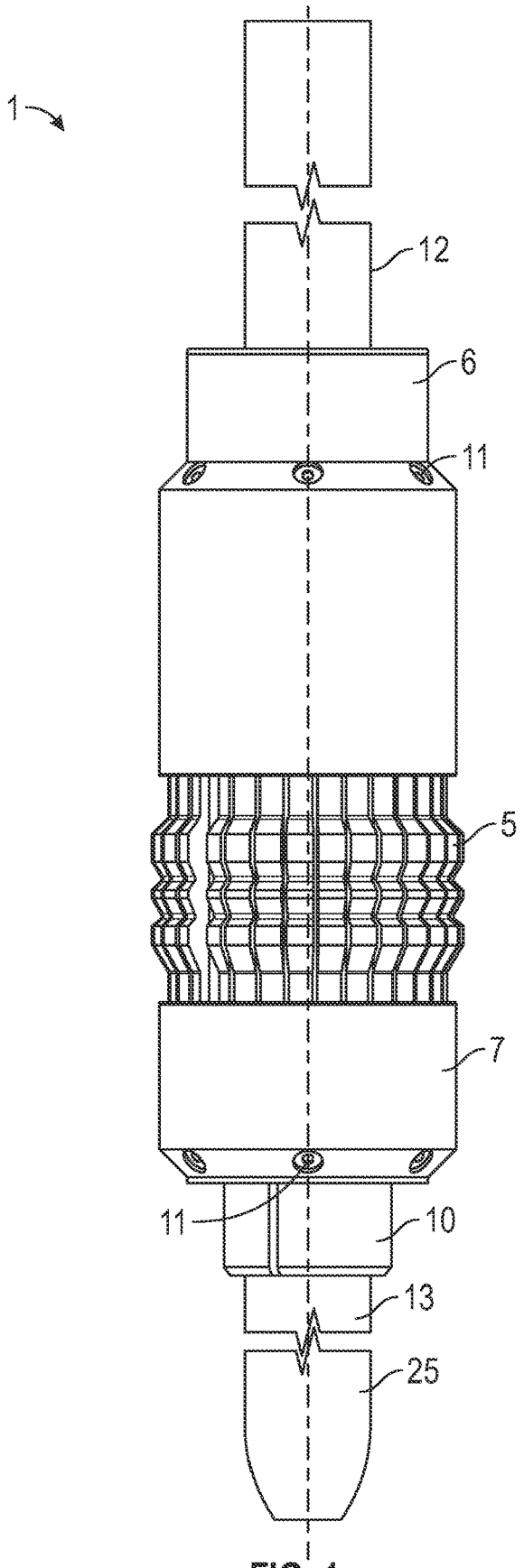
FIG. 1 is a schematic side view of a RCD bearing deployment tool (RBDT) in accordance with the invention.
Figure 2:
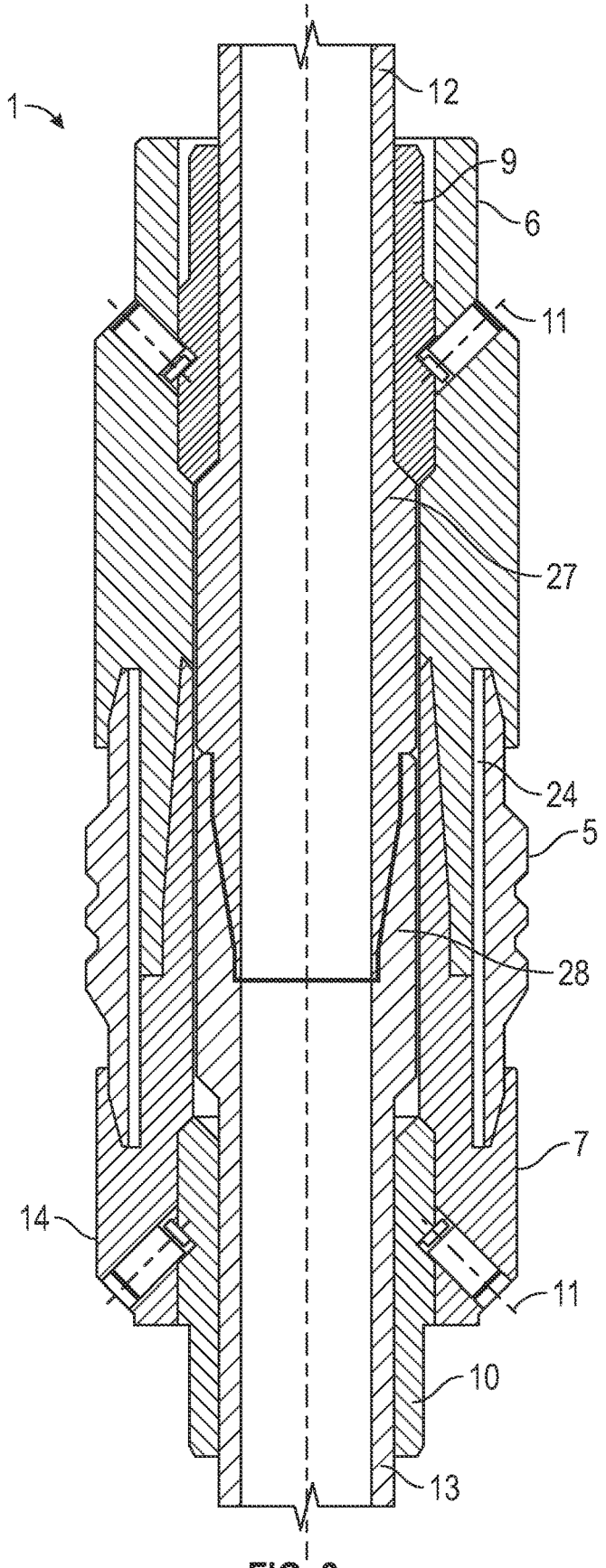
FIG. 2 is a schematic cross section of the RBDT illustrated in FIG. 1 and installed on a drillpipe.

Referring now to FIG. 1 and FIG. 2, these show a schematic side view of the RCD bearing deployment tool (RBDT) assembly 1 and a schematic cross section of the RBDT installed on a drillpipe, respectively. Like items are labeled the same. The drillpipe comprises two section of drillpipe 12, 13 which are joined end to end, and we can see that RBDT is mounted around the tool joint where the upper drillpipe 12 is connected to the lower drillpipe 13. The tool joint has a larger outer diameter than the remainder of the drillpipe 12. Lower drillpipe 13 may sometimes have a stabbing adapter 25 to facilitate passage through the stripper rubber if the tool is latched on the rig floor. The upper drillpipe 12 has a pin joint 27 and the lower drillpipe 13 has a box joint 28. The RBDT consist of five main pieces: a top housing 6 that is threaded to a lower housing 7, a the "grasp split ring" 5 that is trapped between the top housing 6 and the lower housing 7, and an upper adapter 9 and a lower adapter 10. These adapters 9, 10 in use form a tubular sheath or sleeve around the upper and lower drillpipe 12, 13 respectively. As the adapters 9, 10 have an inside diameter which is smaller than the outer diameter of the tool joint, they could not be mounted on the drillpipe 12, 13 by sliding over the larger diameter of the tool-joint. As such, rather than each being formed as a single tubular piece, they are split longitudinally. Advantageously they are split into two parts, but they could be split into more than two parts. Each adapter piece is secured by a bolt 11—the upper adapter 9 to the upper housing 6 and the parts of the lower adapter 10 to the lower housing 7, so that each adapter 9, 10 forms a tubular sheath around the drillpipe 12, 13 above or below the tool joint. As such, several bolts are required to secure each adapter 9,10. The grasp split ring 5 is the latch. The dimensions of the latch 5 and the dimensions of items 6 and 7 are fixed in the design.

The top housing 6, lower housing 7 and grasp split ring 5 are secured to the drillpipe 12, 13 by the upper adapter 9 and lower adapter 10 as will be described further below. As such, the dimensions of the grasp split ring 5, the top housing 6 and lower housing 7 are optimized for the largest commonly used drillpipe—that is 6⅝ inches nominal OD with tool joints being 8.5 inches in nominal diameter with some allowance for hardbanding (raised circumferential band of hardwearing material that may be raised). As such, the top housing 6, lower housing 7 each have an internal diameter of at least 9 inches, and the grasp split ring 5 an internal diameter which is even greater than 9 inches, and this need not be changed in order for these to be mounted on a smaller diameter drillpipe. The only items that are sized differently depending on the size of drillpipe are the upper adapter 9 and lower adapter 10. While retaining their outer diameters constant to interface with the corresponding top and lower housings 6 and 7, the inner diameter of the adapters 9, 10 is changed to accommodate different smaller drill pipe sizes. Their length will also change as the smaller tool joint may have shorter axial dimensions than the large 6⅝ nominal drillpipe tool-joint.

The RBDT is secured to a drillpipe as illustrated in FIG. 2. The two adapters 9, 10 are both longitudinally split tubular sleeves with an interior surface having a circular transverse cross-section with a diameter which is just slightly greater than the outer diameter of the portions of the upper and lower drillpipes 12, 12 adjacent to the tool joint 27, 28, and significantly smaller than the outer diameter of the tool joint 27, 28. As such, when mounted around the drill pipes 12,13 sliding movement of the adapters 9,10 along the drill pipe 12, 13 is restricted by the tool joint 27, 28. In this embodiment the adapters are split into two parts which together form a tube. The parts of the upper adapter 9 are mounted around the upper drillpipe 12 just above the pin joint 27, whilst the parts of the lower adapter 10 are mounted around the lower drillpipe 13 just below the box joint 28. The top housing 6, and lower housing 7 are also tubular. The top housing 6 is mounted around the upper adapter 9 whilst the lower housing 7 is mounted around the lower adapter 10. The top housing 6 has a first end which is secured to the upper adapter 9 using bolts—at least one bolt being provided for each part of the upper adapter 9, and a second end which extends around the pin joint and 27 and the box joint 28. Similarly, the lower housing 7 has a first end which is secured to the lower adapter 10 using bolts—at least one bolt being provided for each part of the lower adapter 10, and a second end which extends towards the top housing around the box joint 28 and pin joint 27. The interior diameter of the lower and upper housings 6,7 are sized such that they are slightly greater than the outer diameter of the tool joint for the largest diameter drillpipe on which the RBDT is to be used.

The radially outward facing surfaces of the top and lower housings 6, 7 are each provided with an annular latch retainer formation which extends axially towards the other housing from a point approximately midway between the two ends of the housing, and which forms an annular latch retainer groove in which is lodged one end of the latch 5. The latch is thus trapped between the top housing 6 and lower housing 7. There is an annular flex space between the latch 5 and the upper/lower housings 6/7 that serves to allow movement of the latch radially inwards. This will be described in more detail with FIGS. 4A and 4B.

Figure 3:
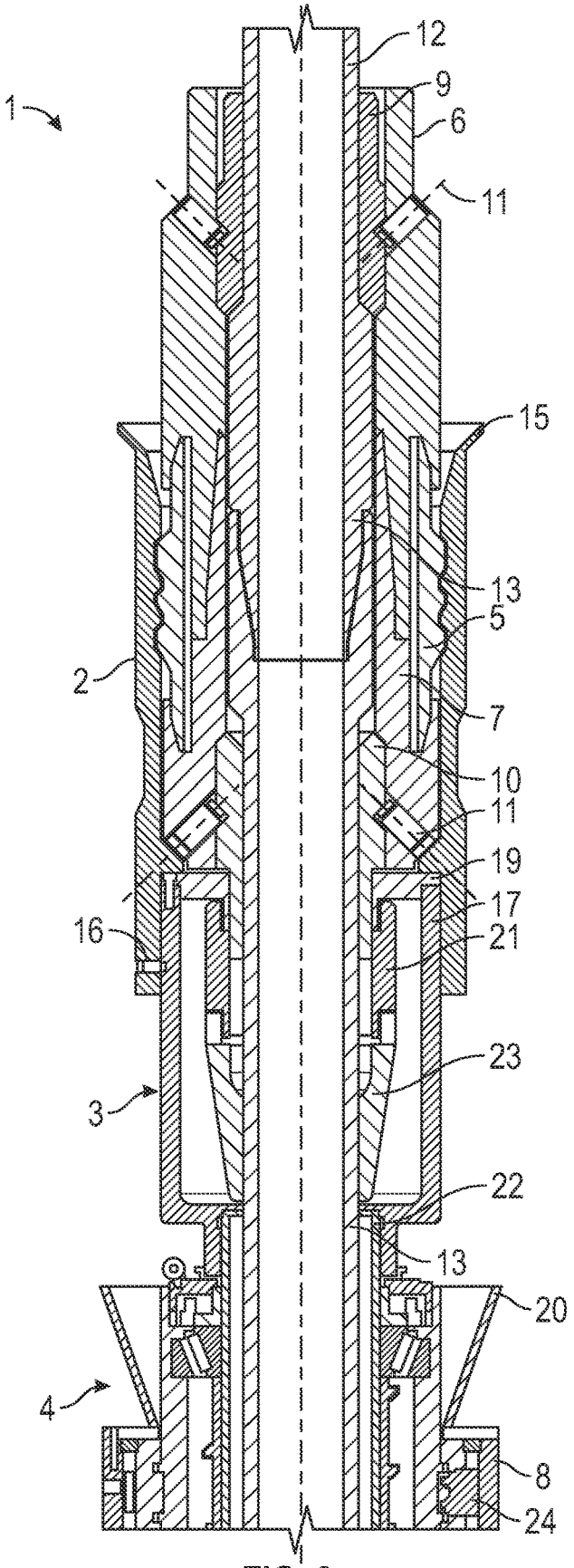
FIG. 3; is a schematic cross section view of the RBDT illustrated in FIG. 1 in use attached to an RCD bearing assembly that has just been landed in an RCD housing.

FIG. 3 is a schematic cross section view of the RBDT assembly 1 in use, attached to an RCD bearing assembly 3, that has just been landed in an RCD housing assembly 4 (partially shown), which is connected to the top of a blowout preventer or other stack. The RCD housing assembly 4 has an RCD housing 8 with a funnel 20 mounted at its uppermost end. To land the RCD bearing assembly 3 on the RCD housing assembly 4, the RBDT is secured to the RCD bearing assembly 3 by engaging latch 5 with a corresponding funnel latch 2, which is secured to the top of the RCD bearing assembly by bolts 16 bolting into the upper RCD bearing bowl 17. This bowl 17 has a lid 19 that supports an annular flex element 21 to which the upper stripper element 23 is attached. There is a similar lower stripper element that is not shown.

With the RCD bearing assembly 3 secured by funnel latch 2 to latch 5, RBDT is used to lower the RCD bearing assembly 3, guided by the funnel 20, onto the RCD housing 8 until it hits a landing shoulder (further below, not seen). Now main latches 24 on the RCD housing 8 can be engaged with corresponding formations on the RCD bearing assembly, locking the RCD bearing assembly in place. With the latches 24 closed, the drillpipe 12 can be pulled creating upward tension on the latches 24. This initially serves to verify that the latches are completely engaged and secure. Then, if the pulling force is increased further to a specified overpull, the latch 5 releases from the funnel latch 2 and the RBDT tool 1 can be retrieved to the rig floor. Typically, this tool will be on the bottom of a stand (3 pipes) and this stand will be broken out and racked back in drilling tower, before picking up a fresh stand and continuing with the planned operation of running in hole to drilling depth.

It can be appreciated that the RCD housing 8 can be an integral housing in an offshore riser, or some other type of latch system in the riser designed to hold an RCD bearing assembly. As such the RBDT tool can be used under a variety of conditions. The latch 5 can be attached to any tool that has a corresponding profile to funnel latch 2, like a liner hanger or other such tools or systems.

If the drilling rig changes to a smaller drillpipe as is common when the hole size decreases with greater depth, then the RBDT can be removed from the larger drillpipe and easily assembled onto a smaller drill pipe simply by changing the adapters 9 and 10. Thus a very cost effective tool is defined by this invention with a minimum of parts. Furthermore, as the RBDT merely rests on the tool joint, it can be employed with a standard drill pipe without the need to make any modifications to the drill pipe, and the full load path through the drillpipe is maintained at all times with this design, and the weight of the drill string below is not carried by the RBDT. The RBDT tool only sees minor differential loads required for operational verification like setting down to check RCD bearing assembly has landed, pulling up to check latching of RCD, overpulling to release the latch 5 being the largest load typically much less than the full drill string weight.

This makes for a much easier design than an integral RCD pulling and running tool where the integrity of the tool and the threads connecting to the drillpipe must be inspected at same intervals as the drillpipe, and where it is necessary to have several versions of the tool or a large number of crossovers in stock to adapt it for different drillpipe sizes. Crossovers also slow down deployments as they have to be made up and broken out interrupting the normal pipe running sequence involving changes in pipe slips and other procedural steps lengthening the deployment time of integral RBDT design. Thus the advantageous modular nature of this "modular RBDT" has been described.

Figure 4A:
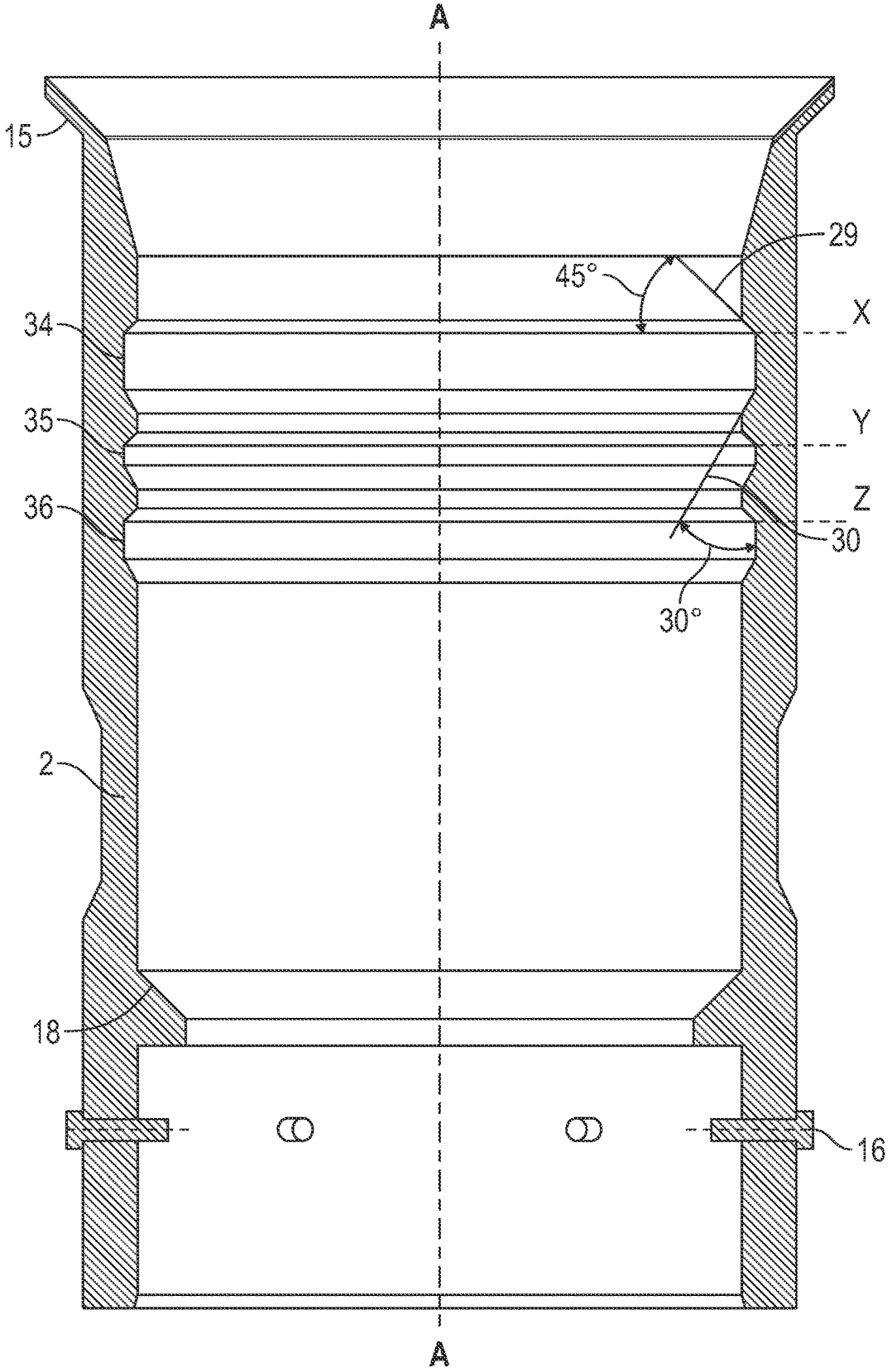
FIG. 4A is a schematic cross section of the funnel latch assembly of the RBDT illustrated in FIG. 1.
Figure 4B:
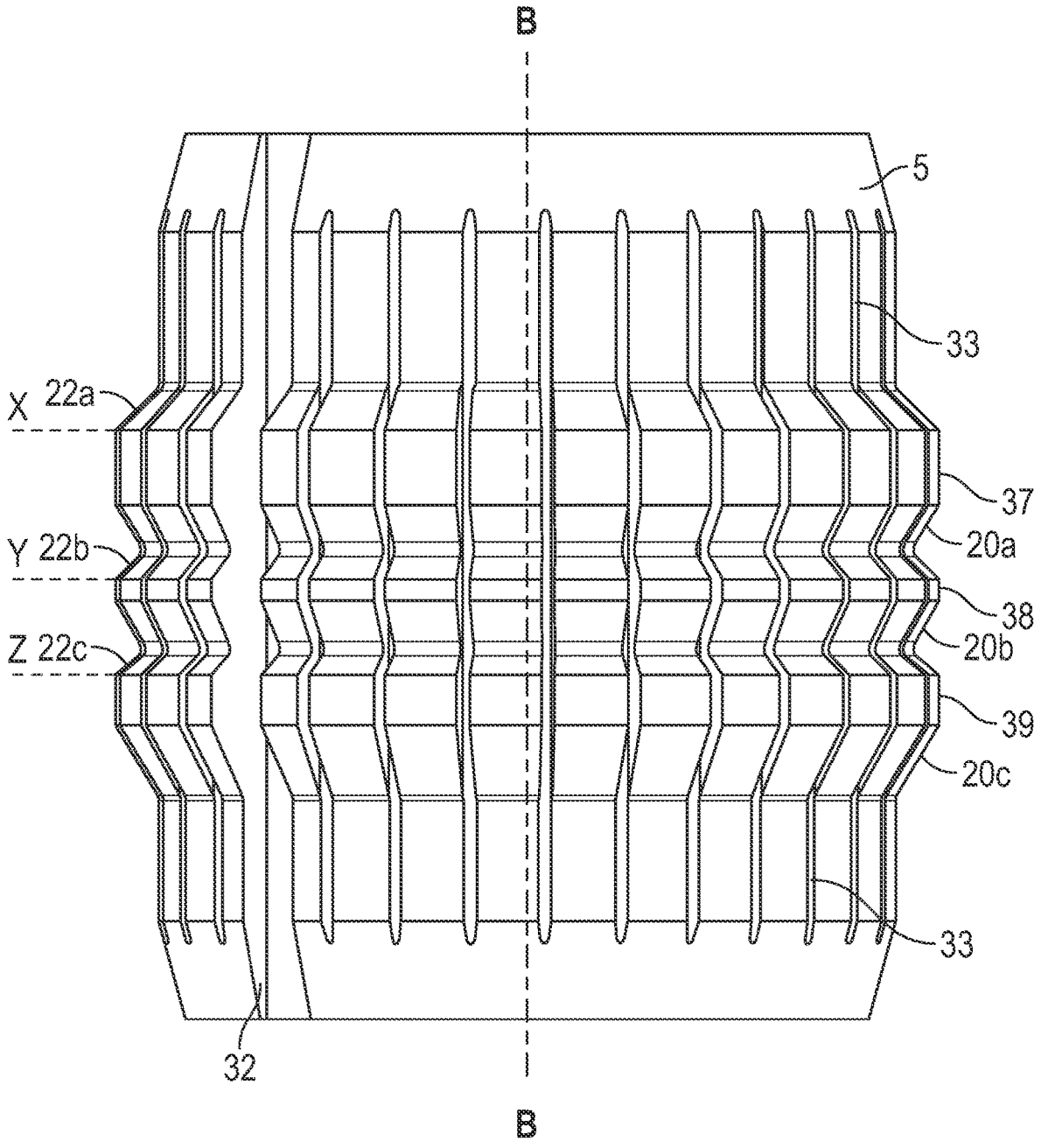
FIG. 4B is a schematic cross section of the grasp slit ring of the RBDT illustrated in FIG. 1.

We now describe the novel features of the latch mechanism by reference to FIG. 4A which is a schematic cross section of the funnel latch 2 and FIG. 4B, a schematic cross section of the grasp slit ring-latch 5. For clarity the two parts: latch funnel 2 and latch 5 have been aligned with trim lines x, y, and z showing the alignment between the 2 parts when fully latched. The funnel latch 2 has a tubular body with lower end and an upper end, which encloses a generally cylindrical main passage with a longitudinal axis A. It is provided with a landing shoulder 18, which extends from a radially inwardly facing surface of the tubular body into the main passage, on which the bottom of the lower adapter 10 lands when the latch 5 is at the latching depth. The upper end of the body of the funnel latch 2 flares outwardly to provide a guide 15, and the bolts 16 by means of which the funnel latch 2 is secured to the upper RCD bearing bowl 17 are located adjacent to the lower end of the body.

The latch funnel 2 and latch 5 can be designed in a variety of ways to give the latching characteristics required. In this design, the radially inwardly facing surface of the body of the funnel latch 2 is provided with circumferential recesses 34, 35 and 36 which are located between the landing shoulder 18 and the first end 2*a* of the funnel latch 2. These recesses 34,35, 36 are configured to receive corresponding annular ridges 37, 38 and 39 on the latch 5. These recesses/ridges have differing axial dimensions that can be tailored as required. Also, instead of three recesses/ridges there can be only one, or two, or more than three.

The latch 5 is also tubular, and has a body which encloses a generally cylindrical passage 5*a* with a longitudinal axis B. The radially outwardly facing surface of the latch 5 is provided with three circumferential annular ridges 37, 38, 39 which, as mentioned above, will lodge in the recesses 34, 35, 36 in the funnel latch 2 when the latch 5 is latched to the funnel latch 2.

Each annular ridge 37, 38, 39 is provided with two angled shoulders 20*a*, 22*a*, 20*b*, 22*b*, 20*c*, 22*c* over which the outer diameter of the latch 5 increases generally linearly to its maximum. Each annular recess 34, 35, 36 is provided with two correspondingly angled shoulders. In this example, the shoulder angles 29, 30, i.e. the angle of the radially outwardly facing surface of the latch 5 at the shoulder to the axis B, for the two shoulders of each annular ridge 37, 38, 39/recess 34, 35, 36 are different as will be discussed in more detail below.

The latch 5 also has a main slot 32 which extends parallel to the axis B and all the way through the body, so that the latch 5 has a generally C-shaped transverse cross-section. This allows radial inward flexion of the latch 5. The latch is also provided with several smaller slots which also extend into the body generally parallel to axis B, but these do not fully penetrate through the body. They just provide reduced thickness portions of the body to give additional radial flex capabilities. In this sense, the latch is a singular item very different from dogs or individual multiple vertical latches. It will be made of a spring steel or where hydrogen sulfide resistance is required out of titanium. It is designed to be able to flex between the fully open (latched or unlatched) position to compressed position (during latching or unlatching) for many cycles without fatigue. The force required to fully engage the latch i.e. aligned on the x, y and z trim lines and to disengage the latch can be controlled by the shoulder angles 29 and 30 which control latching and unlatching characteristics respectively as well as the number of annular ridges/recesses. The latching force can be decreased by providing fewer than three annular ridges/recesses, or increased by providing more than three annular ridges/recesses.

In this design, the angled shoulders 20*a*, 20*b*, 20*c* of each annular ridge 37, 38, 39 which are on the lowermost side of the respective ridge 37, 38, 39 (i.e. which, in use, are inclined towards the RCD bearing assembly 30)—hereinafter referred to as the entry shoulders 20*a*, 20*b*, 20*c*, have a 30 degree shoulder angle allowing easy entry to latch, whilst the opposite shoulders 22*a*, 22*b*, 22*c* (i.e. those which are inclined to face away from the RCD bearing assembly 3), hereinafter referred to as the unlatch shoulders 22*a*, 22*b*, 22*c*, have a greater shoulder angle of 45 degrees making it harder to unlatch.

For this application when the latch 5 is required to enter the funnel latch 2, on the rig floor to engage the RCD bearing assembly we only have the weight of one drill pipe stand, so as the latch 5 enters the guide 15, it can easily compress on shoulder 20*c* to make for easy latching with a minimum of weight applied. Once fully latched the greater angle on the unlatching shoulders 22*a* to 22*c*, mean that more pulling force is required. For this application a typical force would be 50,000 pounds pull to check that the RCD bearing assembly has been latched with latches 24, then an overpull of 100,000 pounds to release the latch 5.

When removing the RCD bearing assembly, the latch easily enters the funnel, lower adapter 10 of lower housing 7 lands on shoulder 18 of the funnel latch 2, we put some partial weight of drill string, say 50,000 pounds, to verify, go back to neutral, unlatch 24 and pull out the RCD bearing assembly which is securely held as it requires say 100,000 pounds overpull to remove it. Once back at surface some latch compression device (not shown) can be used to release the bearing assembly.

If for some reason the RCD cannot be released, the tool can still be removed by overpulling to say more than 100,000 pounds (exact number depends on the use case and design of the grooves and angles) to retrieve the RBTD and to enable additional steps to be taken without having the RBTD stuck in hole.

It will be appreciated that the force with which the funnel latch 2 can be mounted on the latch 5 can be reduced by decreasing shoulder angle of the entry shoulders 20*a*, 20*b*, 20*c*, and increased by increasing the shoulder angle of the entry shoulders 20*a*, 20*b*, 20*c*. Similarly, the force required to unlatch the funnel latch 2 from the latch 5 in order to detach the RBDT from the RCD bearing assembly 3 can be reduced by decreasing the shoulder angle of the unlatch shoulders 22*a*, 22*b*, 22*c*, and increased by increasing the shoulder angle of the unlatch shoulders 22*a*, 22*b*, 22*c*. It should also be appreciated that, whilst in the embodiments described above, all the ridges/recesses have the same height/depth, this need not be the case. The height/depth of one or more of the ridges/recesses could be increased relative to the others, in order to modify the forces required to latch or unlatch the funnel latch 2 to or from the latch 5. Additionally or alternatively, the force required to latch or unlatch the funnel latch 2 to or from the latch 5 could be altered by varying the width of the ridges 37, 38, 39 or recesses 34, 35, 36, i.e. the length parallel to the longitudinal axis A of the radially outward/inward surface of the latch 5 or funnel latch 2 at the peak diameter for each ridge/recess.

Figure 5:
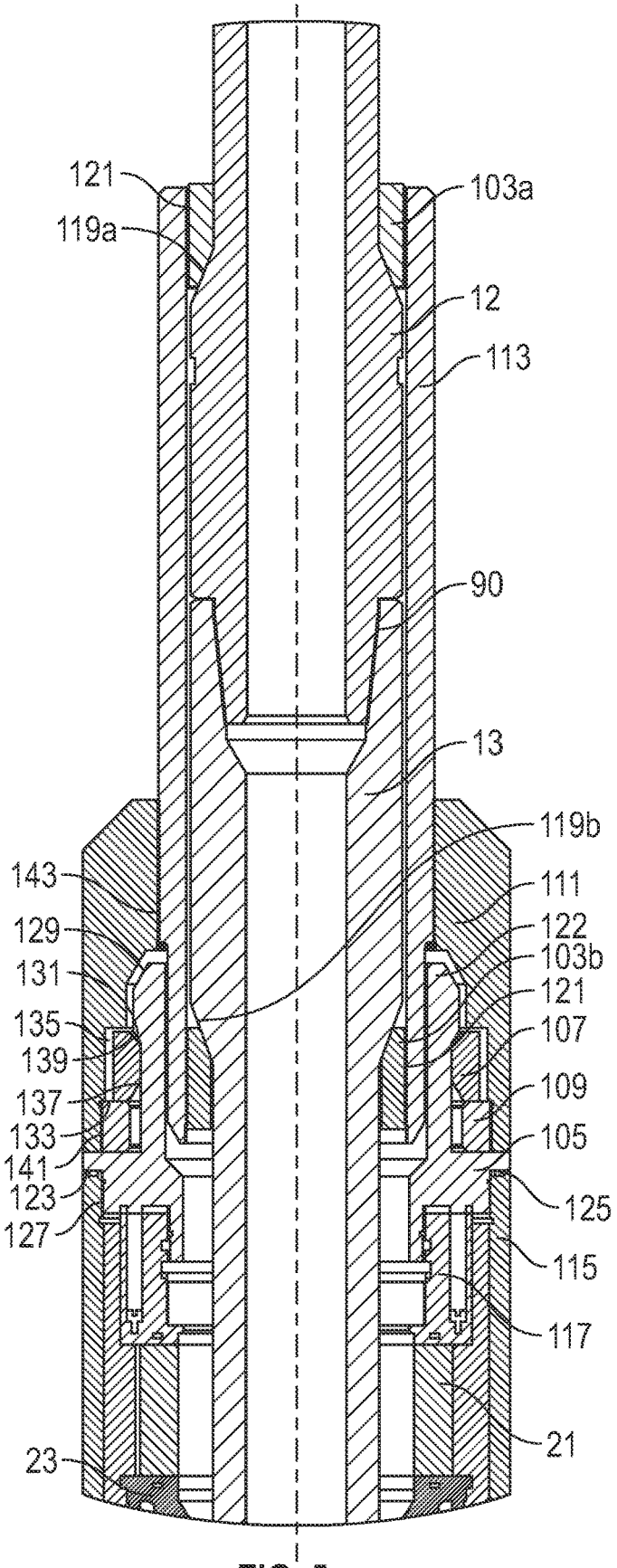
FIG. 5 shows an alternate embodiment of the invention.
Figure 6:
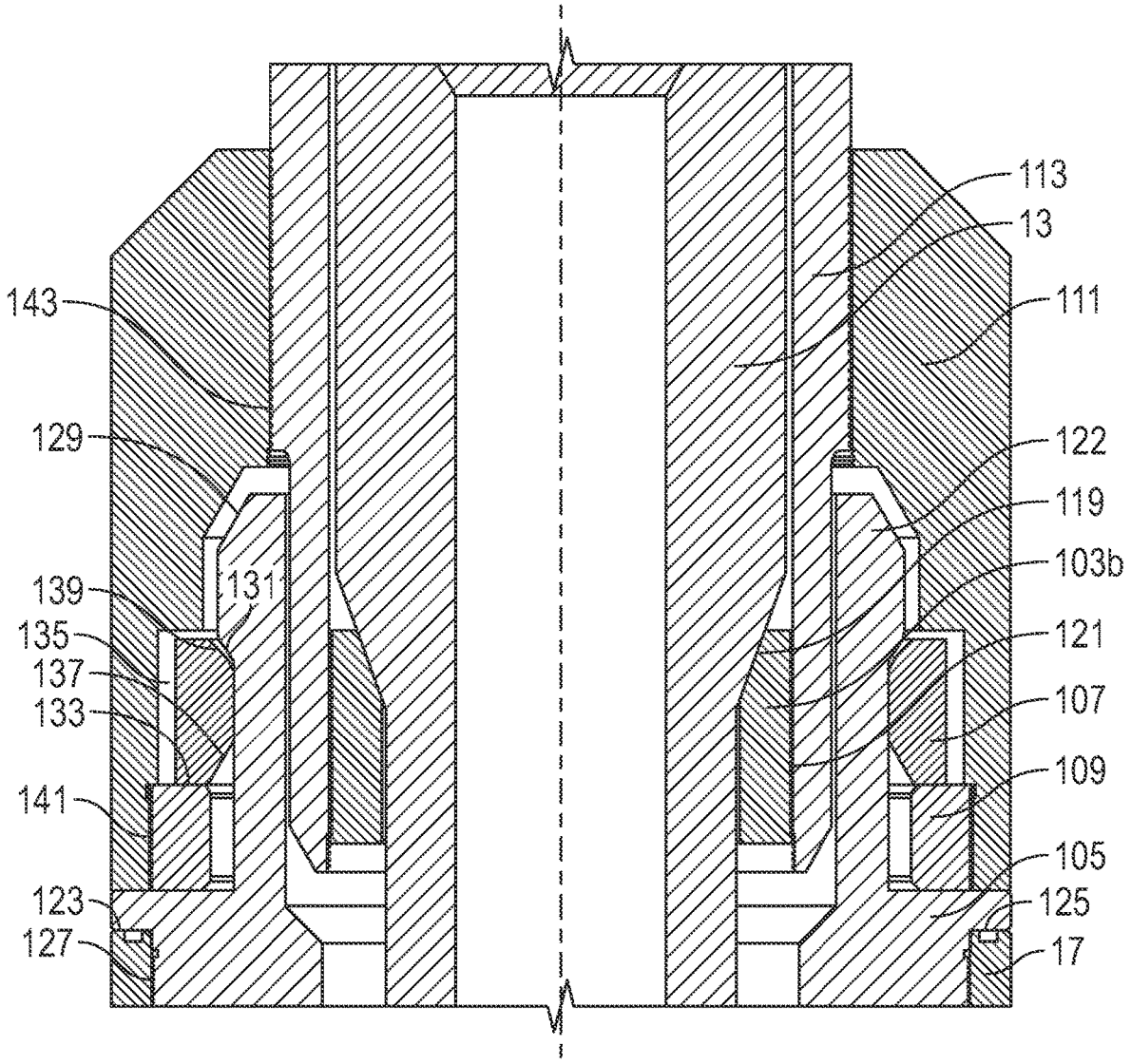
FIG. 6 shows the latching detail of the alternative embodiment of FIG. 5.

In FIG. 5 and detailed in FIG. 6 an alternative embodiment of the invention is shown. It remains true to the concept of having a Running and Pulling tool that can be installed around a drillpipe tool joint making it independent of the drill string load path as well as independent of the drill pipe thread and drill pipe size. We have an upper drillpipe 12 connected via a thread 90 to a lower drill pipe 13. There is also a center sleeve 113 which can slide over the tool joint. This center sleeve is designed for the largest commonly used drillpipe, 6⅝ inches, such that the tooljoint i.e. the connection between the upper drillpipe 12 and the lower drillpipe 13 can be accommodated within the bore of the central sleeve 113. To retain this sleeve 113 there are split rings 103*a*, 103*b*. The upper split ring 103*a* consists of two vertically split halves that have an external thread. The two halves have the external thread aligned by machining this after splitting the ring. The two split ring halves may have alignment pins for ensuring their exact thread alignment when put together. This can be threaded into the center sleeve as shown by thread 121 between the split ring 103*a* and the center sleeve, and is supported by the upper load shoulder 119 of the upper drillpipe 12. The split ring 103*a* may have axial holes for a spanner with pins to engage for torqueing or other such known method for securing a threaded ring inside a sleeve. It may have locking nuts or bolts (none shown). The lower split ring 103*b* similarly is threaded into the bottom of the center sleeve 113 with a thread 121 in order to engages with the load shoulder 119*b* of the lower drill pipe 13 tool joint. In this manner a simple and effective system is created to secure the sleeve 113 to an upper and lower drill pipe 12, 13 at the tool joint. The tool can be used on a standard drill pipe without the need to make any modifications to the drill pipe and whilst maintaining the full load path along the drill pipe, and does not support the weight of the drill pipe below it. Different sized split rings can be provided to accommodate smaller diameter drill strings and tool joints. The center sleeve bore will always remain the same as it is designed for the largest drillpipe as mentioned earlier, as its inside diameter and the length are set to accommodate the largest drillpipe size. For the split rings 103*a* and 103*b*, the outer threaded diameter will remain the same but the diameter of the bore as well as their length is changed for different size tool joints (drill pipe sizes). The split rings need to be longer for smaller drill pipe sizes so that they still allow a spanner or other securing tool to be used, as the tool joint will be shorter so the split rings will penetrate deeper into the center sleeve 113.

Now, the secured center sleeve 113 can be used to attach a latching mechanism. In this particular embodiment this consists of a locking sleeve 111 that is threaded onto the center sleeve 113 with the thread 143 and securely torqued. It may have additional locking nuts or other thread-locking mechanisms to ensure the parts 113 and 111 can not come apart when in use. For this continued description the retrievable latching tool consists of items 113, 111, 103*a/b*, 107 and 109. These parts are able to disengage from the extension of the RCD bowl 115 and be retrieved to surface with the drill pipe.

The RCD bowl 115 has a housing cap 117 that is used to attach the flex element 21 and drill pipe stripper 23 similar to the embodiment in FIG. 1. However a different RCD bowl cap 105 is installed by a thread 127 and sealed by a face seal 125 captured at the landing shoulder 123. This bowl cap 105 has a circumferential latching profile 122 at the top. This is the engagement/disengagement point for the latching assembly consisting of parts 111, 107 and 105 on the running/pulling tool that will be described next.

The locking sleeve 111 has an internal circumferential expansion gap 135. In this gap 135 sits a Spring steel C-Ring that can deform axially when force is applied to its shoulders 137 and 139. It is retained by a retainer 109 threaded to the locking sleeve with thread 141. This secures the C-ring 107 so it is not possible to remove, while at the same time giving it enough tolerance by design to expand and contract by force to act as a latch. Other high modulus materials like Tungsten can also be used for this C-ring 107 instead of spring steel.

We will now describe the action of the latch. In FIG. 5 it is shown in the latched position with the C-ring 107 sitting below the latch profile 122. In this state the C-ring 107 is relaxed, not under any force and any planned tolerances are determined by the depth of the landing surface 133. If tension is applied to the drill string then the C-ring retaining shoulder 139 is forced against the latch profile 122 retaining shoulder 131. These shoulders have a high angle of interference in the vertical plane, acting as retainers, meaning a significant force must be applied to force these shoulders past each other by expanding the C-ring 107 into the expansion gap 135. As in the previous example this would typically be designed at 60,000 lbs to 100,000 lbs of force to unlatch. This is enough to enable a tension load of 5,000 lbs to be applied to pull the RCD bearing assembly assuming its weight is less than that. If the RCD assembly has just been installed, then an overpull of 20,000 lbs to 40,000 pounds can be applied to verify retention for the main RCD latch (not shown). If for any reason when trying to pull the RCD bearing it is stuck, then an overpull greater than 60,000 to 100,000 pounds can be used to force an unlatch past the retention shoulders.

Assuming now that the assembly is unlatched, i.e. there is at least a 4 inch gap between parts 111 and 105, then lowering the drillstring will push the lead angle 137 of the C-ring 107 against the lead angle 129 of the latch profile 122. These shoulders have a low angle of interference in the vertical plane, acting as engagers, so only a small force is required, typically 3,000 to 5,000 pounds is required to engage the latch. This allows easy engagement at the surface on the rig floor when there may only be a stand of drillpipe available as the engagement weight.

The lead angle 129 on the RCD cap latching profile 122 and the angle 137 on the C-ring 107 determine the engagement force for latching. Making this less in the vertical will reduce the force required for engagement and increasing it will increase the force of engagement for latching. Similarly varying the angles 131 and 139 on the profile 122 and C-ring 107 respectively can be used to determine the force required for disengagement or unlatching.

The C-ring 107 could be replaced with a different design having multiple shoulders like the grasp split ring 5 as shown in FIG. 1 of the first embodiment. Then differing angles like the ones in the funnel latch 2 of FIG. 1 could be used as a differing design for a latching profile 122.

The key inventive feature of all of the embodiments is that whatever method of latch design is used, the tool is an independent assembly from the drillstring and can thus be easily applied to many different types of drill string design without having to have threaded interfaces for insertion into a drill string.

Whilst the invention has been described in relation to the deployment of an RCD bearing assembly onto an RCD housing, the deployment tool described in this application need not be limited to this. For example, it could be used to deploy a liner hanger, tubing hanger, casing hanger, or any other temporary completion tool.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the scope of the invention.

What is claimed is:

1. A deployment tool comprising:

a latch assembly and two adapters, whereby the latch assembly is operable to be releasably secured to a drill string, the latch assembly comprising:

a tubular housing with an interior surface; and a resiliently deformable latch retained by the housing;

wherein the adapters are releasably secured to the interior surface of the housing and the adapters are spaced from one another along the housing; and wherein at least one of the radially inwardly facing surface or a radially outwardly facing surface of the latch has a circumferential ridge including two angled shoulder over which an inner or outer diameter of the latch decreases or increases linearly to a minimum or a maximum at a peak of the circumferential ridge.

2. The deployment tool according to claim 1, wherein the adapters are tubular or annular.

3. The deployment tool according to claim 1, wherein the adapters are formed from a plurality of arcuate parts which together partially or completely surround a portion of the drill string.

4. The deployment tool according to claim 1, wherein the latch is tubular, and has a body which encloses a cylindrical passage with a longitudinal axis.

5. The deployment tool according to claim 4, wherein the latch has a main slot which extends parallel to the longitudinal axis and all the way through the body, so that the latch has a C-shaped transverse cross-section.

6. The deployment tool according to claim 5, wherein the latch is a plurality of smaller slots which also extend into the body parallel to the longitudinal axis, but which do not fully penetrate through the body.

7. The deployment tool according to claim 1, wherein an angle of the radially inwardly or outwardly facing surface of the latch at the shoulder with respect to a longitudinal axis of the latch are different for the two shoulders of the circumferential ridge.

8. The deployment tool according to claim 1, wherein the latch assembly housing comprises first and second housings, the first housing being mounted around and releasably secured to the first adapter and the second housing being mounted around and releasably secured to the second adapter, and each of the first and second housings having a latch retainer formation which receives one end of the latch so that the latch is captured between the first and second housings.

9. The deployment tool according to claim 1, wherein the latch assembly housing comprises first and second housings, the first housing being secured to the first and the second adapter, and the second housing having a latch retainer formation which receives and retains the latch.

10. A deployment tool assembly comprising:

a first and second drill pipe connected end to end by a tool joint which has a larger outer diameter than adjacent portions of the drill pipes; and a latch assembly and two adapters, the latch assembly comprising:

a tubular housing with an interior surface; and a resiliently deformable latch which is retained by the housing;

wherein the adapters are releasably secured to the interior surface of the housing spaced from one another along the housing, the first adapter mounts around the first drill pipe adjacent to the tool joint, and the second adapter mounts around the second drill pipe adjacent to the tool joint, so that the tool joint lies between the first and second adapters.

11. The deployment tool assembly according to claim 10, wherein the adapters are tubular or annular.

12. The deployment tool assembly according to claim 10, wherein the adapters are formed from a plurality of arcuate parts which together partially or completely surround a portion of the first and second drill pipe.

13. The deployment tool assembly according to claim 10, wherein the latch is tubular, and has a body which encloses a cylindrical passage with a longitudinal axis.

14. The deployment tool assembly according to claim 13, wherein the latch has a main slot which extends parallel to the longitudinal axis and all the way through the body, so that the latch has a C-shaped transverse cross-section.

15. The deployment tool assembly according to claim 14, wherein the latch has several smaller slots which also extend into the body parallel to the longitudinal axis, but which do not fully penetrate through the body.

16. The deployment tool assembly according to claim 10, wherein at least one of a radially inwardly or a radially outwardly facing surface of the latch has a first circumferential ridge.

17. The deployment tool assembly according to claim 16, wherein the first circumferential ridge is provided with two angled shoulders over which an inner or an outer diameter of the latch decreases or increases linearly to a minimum, or a maximum at a peak of the first circumferential ridge.

18. The deployment tool assembly according to claim 17, wherein an angle of the radially inwardly or outwardly facing surface of the latch at the shoulder relative to a longitudinal axis of the latch are different for the two angled shoulders of the first circumferential ridge.

19. The deployment tool assembly according to claim 10, wherein the housing comprises a first housing which is secured to the first adapter, and a separate second housing which is secured to the second adapter, and the latch is located in the latch retainer formation of each housing so that the latch lies between and is captured by the first and second housing.

20. The deployment tool assembly according to claim 16, wherein the deployment tool assembly further comprises a tool which comprises a tool latch and is mounted on the deployment tool assembly by engagement of a second circumferential ridge or a groove provided on the tool latch of the tool with the first circumferential ridge of the latch of the deployment tool assembly.

21. The deployment tool assembly according to claim 20, wherein the first circumferential ridge has two angles shoulder over which an inner or an outer dimeter of the latch decreases or increase linearly to a minimum or a maximum at a peak of the first circumferential ride and a first angle of the radially inwardly or radially outwardly facing surface of the latch at the shoulders closer to the tool to which the deployment tool is connected is less than a second angle of the radially inwardly or radially outward facing surface of the latch at the shoulder further from the tool.

* * * * *